US011497252B2

(12) United States Patent
Santos

(10) Patent No.: US 11,497,252 B2
(45) **Date of Patent: *Nov. 15, 2022**

(54) VAPORIZATION DEVICE

(71) Applicant: Rodrigo Escorcio Santos, Rockville, MD (US)

(72) Inventor: Rodrigo Escorcio Santos, Rockville, MD (US)

(73) Assignee: Rodrigo Escorcio Santos, Rockville, MD (US)

( * ) Notice: Subject to any disclaimer, the term of this patent is extended or adjusted under 35 U.S.C. 154(b) by 70 days.

This patent is subject to a terminal disclaimer.

(21) Appl. No.: 17/392,466

(22) Filed: Aug. 3, 2021

(65) Prior Publication Data

US 2022/0000179 A1 Jan. 6, 2022

Related U.S. Application Data

(63) Continuation of application No. 16/950,976, filed on Nov. 18, 2020, which is a continuation-in-part of application No. 16/902,333, filed on Jun. 16, 2020, which is a continuation of application No. 16/686,339, filed on Nov. 18, 2019, now Pat. No. 10,786,006.

(60) Provisional application No. 62/769,687, filed on Nov. 20, 2018.

(51) Int. Cl.

| | |
|---|---|
| ***A24F 1/30*** | (2006.01) |
| ***A24F 40/465*** | (2020.01) |
| ***A24F 40/48*** | (2020.01) |

(52) U.S. Cl.

CPC ..... *A24F 40/465* (2020.01); *A24F 1/30* (2013.01); *A24F 40/48* (2020.01)

(58) Field of Classification Search

CPC ..... A24F 9/00; A24F 47/006; A24F 40/05; A24F 47/00; A24F 1/30; A24F 42/00; A24F 42/20; A24F 42/60; A61M 15/06

See application file for complete search history.

(56) References Cited

U.S. PATENT DOCUMENTS

| | | | | |
|---|---|---|---|---|
| 3,211,158 A | | 10/1965 | Shih | |
| 4,198,993 A | * | 4/1980 | Martin et al. ..... | A47G 19/2205 131/196 |
| 2005/0279371 A1 | * | 12/2005 | Billard et al. ..... | A24F 1/30 131/185 |

* cited by examiner

*Primary Examiner* — Dionne W. Mayes

(74) *Attorney, Agent, or Firm* — Edell, Shapiro & Finnan, LLC

(57) ABSTRACT

A vaporization apparatus configured to support a vaporization rig and a heating element, comprises a body including an interior cavity and a top surface. The interior cavity supports the heating element. The top surface defines a first receptacle sized to support a first portion of the vaporization rig and a second receptacle sized to support a second portion of the vaporization rig. The first receptacle is fluidly coupled to the second receptacle, and the interior cavity and the second receptacle are positioned to align a heatable portion of the vaporization rig with a heat generating portion of the heating element.

20 Claims, 14 Drawing Sheets

VAPORIZATION DEVICE

CROSS-REFERENCE TO RELATED APPLICATIONS

This application is a continuation of U.S. Non-provisional patent application Ser. No. 16/950,076, which was filed on Nov. 18, 2020, which is a continuation-in-part of U.S. Non-provisional patent application Ser. No. 16/902,333, which was filed on Jun. 16, 2020, which is a continuation of U.S. Non-provisional patent application Ser. No. 16/686,339, which was filed on Nov. 18, 2019, and which claims priority to and the benefit of U.S. Patent Application No. 62/769,687, filed Nov. 20, 2018. The entire contents of each of these applications are incorporated by reference herein.

FIELD OF THE INVENTION

The present invention is directed toward a vaporization device, and in particular, to a vaporization device that is or includes a vaporization rig and a torch.

BACKGROUND OF THE INVENTION

In view of developments in technology and the law, vaporization devices have become quite popular. Often, to function, a vaporization device heats a consumable and/or inhalable product such as oils, concentrates, combustible plant substances to create a vapor for a user to inhale. Heating liquid or wax consumables has become particularly popular since liquids and waxes may be more concentrated and/or specialized as compared to plant substances and because a quantity of wax or liquid may last longer than a similar quantity of plant substance (which may further decrease the amount of materials that a vaporization user needs to carry).

Often, vaporization devices are portable and fit easily into a pocket included in a garment. For example, portable vaporization devices may be shaped and sized like pens. However, there are disadvantages associated with pens related to volume and taste that cause some users to use vaporization rigs instead of vaporizations pens. Unfortunately, among other issues, vaporization rigs are typically large, burdensome, hard to transport, indiscreet, and hard to use with one hand. For example, typically a user must hold a rig in one hand (or find a stable surface to support the rig) and hold a torch in their other hand in order to operate the vaporization rig. Consequently, improved vaporization devices are desirable.

SUMMARY OF THE INVENTION

A vaporization device that combines a vaporization rig and a heating element is presented herein. In a first configuration, the vaporization device aligns a nail of a vaporization rig with heat generated by a heating element that is supported by the device. Thus, a user can easily use the vaporization device with one hand. In some embodiments, the vaporization device can also be re-configured to accommodate a second rig with different dimensions than a first rig.

According to one embodiment, the present application is directed to a vaporization apparatus configured to support a vaporization rig and a heating element. The vaporization apparatus includes a body includes an interior cavity and a top surface. The interior cavity supports the heating element. The top surface defines a first receptacle sized to support a first portion of the vaporization rig and a second receptacle sized to support a second portion of the vaporization rig. The first receptacle is fluidly coupled to the second receptacle, and the interior cavity and the second receptacle are positioned to align a heatable portion of the vaporization rig with a heat generating portion of the heating element In at least some of these embodiments, the interior cavity is sealed so that the heating element is irremovably secured within the interior cavity. This may prevent the torch from being used or handled in an unsafe manner while also ensuring that a torch is always available for the vaporization device. In some embodiments with a sealed interior cavity, the body may defines a passageway that allows the heating element to be refueled or recharged.

In some embodiments, the first portion of the vaporization rig includes a main body configured to receive a fluid and a mouthpiece that is fluidly coupled to the main body. Additionally or alternatively, the second portion of the vaporization rig is a nail with a nail receptacle. Since a rig (or water pipe or mouthpiece) and a nail to attach the vaporization device separately, the device may be compatible with a wide range of user accessories. This may also reduce the overall size of the device, since a large rig is not needed. In at least some of these embodiments, the body further defines a passageway between the first receptacle and the second receptacle.

Still further, in some embodiments, the body defines a heat outlet for the heat generating portion of the heating element and the second receptacle being disposed between the heat outlet and the first receptacle. This may allow the nail to align with the heating element within a reduced overall footprint. For example, in some instances, the body extends from a front end to a back end and the first receptacle is disposed adjacent the back end, the heat outlet is disposed adjacent the front end, and the second receptacle is disposed therebetween. This may also position the heat outlet furthest from the rig, which a user engages to inhale vapor. Still further, in some instances, the body defines an actuator at the front end. This may naturally align with a user's fingers when a user grips the vaporization device while the rig is positioned on or adjacent the user's mouth. In fact, in some instances, the body defines contours between the front end and the back end to provide a grip sized to be held by a user in a one hand.

According to one embodiment, the present application is directed to a vaporization device includes a support structure, a heating element, a nail, and a mouthpiece. The support structure includes a front end, a back end, and a top with at least one receptacle formed therein. At least a portion of the heating element is positioned within the support structure. The nail and the mouthpiece are securable in the at least one receptacle of the support structure, and securing the nail and the mouthpiece in the support structure aligns a heatable portion of the nail with a heat generating portion of the heating element. Thus, the vaporization device provide a compact unit with all of the necessary components for vaporizing.

In various embodiments, the support structure can include any components or features of, and realize the advantages of the vaporization apparatus discussed above. Additionally or alternatively, the heating element may be a torch or an electric heating element. A torch may be positioned to direct a flame onto a bottom of the heatable portion. An electric heating element may include coils that heat an inhalable substance in the heatable portion. For example, the heatable portion may have an open bottom, and the electric heating element may be positioned within the support structure to define a bottom of the open bottom of the heatable portion.

Still further, in some embodiments, the nail and the mouthpiece are each removably securable to the support structure. Additionally or alternatively, the mouthpiece may be part of a rig that also includes a main body configured to receive a liquid substance.

According to another embodiment, the present application is directed to a vaporization apparatus configured to support a vaporization rig and a heating element. The vaporization apparatus includes a body with a back end, a front end with a hole that extends towards the back end, the hole being configured to support the heating element, and a top surface. The top surface defines a receptacle sized to support the vaporization rig, the hole and the receptacle is positioned to align a heatable portion of the vaporization rig with a heat generating portion of the heating element.

In at least some of these embodiments, the hole is a through hole that extends through the front end and the back end. Alternatively, the hole may be closed at one of the back end and the front end. Additionally or alternatively, in some embodiments the receptacle includes a bottom and one or more sides that surround a perimeter of the bottom. The sides are configured to frictionally engage sidewalls of a main body of the vaporization rig to support the vaporization rig in the receptacle. For example, the receptacle may be a cuboidal receptacle and the main body of the vaporization rig is shaped to mate with the cuboidal receptacle.

Still further, in some embodiments, the vaporization apparatus includes a grip member disposed between the receptacle and the vaporization rig, the grip member configured to increase an amount of friction between the receptacle and the vaporization rig. In some of these embodiments, the grip member is fixedly coupled to a bottom surface of the receptacle. Additionally or alternatively, the grip member may be a sleeve that wraps around a bottom and at least a portion of sidewalls of a main body of the vaporization rig. The sleeve also engages a bottom surface and sidewalls of the receptacle. In some of these sleeve embodiments, the grip member is removably coupleable to at least one of the receptacle and the main body of the vaporization rig.

In any of the foregoing embodiments, the hole may be spaced from the top surface by a longitudinal distance that longitudinally aligns a bottom of the heatable portion of the vaporization rig with heat generated by the heat generating portion of the heating element. Additionally or alternatively, the body of the vaporization apparatus may be sized to be held by a user in a one hand.

According to one embodiment, the present application is directed to a vaporization device including a support structure, a heating element, and a vaporization rig. The including support structure includes a front end, a back end, a top, a bottom, a receptacle formed in the top, and a hole formed in the front end. The hole extends towards the back end of the support structure. A portion of the heating element is insertable the hole of the support structure and the vaporization rig is securable in the receptacle of the support structure. Securing the vaporization rig in the support structure aligns a heatable portion of the vaporization rig with a heat generating portion of the heating element.

In at least some of these embodiments, the heating element comprises a torch and the hole is spaced from the top of the support structure by a longitudinal distance that allows the torch to direct a flame onto a bottom of the heatable portion. In some of these torch embodiments, the torch includes a tank sized to be inserted into and frictionally engage the hole of the support structure. Alternatively, in some embodiments, the heating element comprises an electric heating element with coils that heat an inhalable substance in the heatable portion, the heatable portion has an open bottom, and the hole is spaced from the top of the support structure by a longitudinal distance that orients the electric heating element to define a bottom of the open bottom of the heatable portion. In some of these embodiments, the electric heating element includes a battery compartment sized to be inserted into and frictionally engage the hole of the support structure.

In at least some of the foregoing embodiments, the heating element includes a stop that engages the front end or the back end of the support structure to position a central axis of the heat generating portion of the heating element at a predetermined distance from the front end or the back end of the support structure when the heating element is installed in the hole. The predetermined distance aligns the heatable portion of the vaporization rig with the heat generating portion of the heating element.

According to some embodiments, the vaporization rig includes a main body configured to receive a liquid substance, a nail, and a mouthpiece in fluid communication with the receptacle of the nail via one or more passageways formed in the main body. The nail includes a nail receptacle for an inhalable substance and a neck that positions a central axis of the nail receptacle at a first predetermined distance beyond the front end or the back end of the support structure when the vaporization rig is secured in the receptacle of the support structure. The first predetermined distance aligns the heatable portion of the vaporization rig with the heat generating portion of the heating element. In at least some of these embodiments, the nail is removably mountable in a mount defined in a top of the main body. The mount may be spaced from a front or back of the receptacle of the support structure by a second predetermined distance that positions the nail so that the central axis of the nail receptacle extends the first predetermined distance beyond the front end or the back end of the support structure.

Still further, in some embodiments, the vaporization rig is positionable within the receptacle in a first orientation or a second orientation. The heatable portion extends a first distance laterally beyond the front end of the support structure when positioned in the first orientation and the heatable portion extends a second distance laterally beyond the back end of the support structure when positioned in the second orientation. In at least some of these embodiments, the front end of the support structure is spaced from a front of the receptacle by a third distance and the back end of the support structure is spaced from the receptacle by a fourth distance. The third distance is greater than the fourth distance so that the first distance is smaller than the second distance and the heat generating portion of the heating element is alignable with the heatable portion of the vaporization rig when the vaporization rig is positioned in the first orientation or the second orientation.

BRIEF DESCRIPTION OF THE DRAWINGS

Like reference numerals have been used to identify like elements throughout this disclosure.

DETAILED DESCRIPTION

Presented herein is vaporization device that is or includes a vaporization rig. In some instances, the entire device may be referred to as a vaporization rig, but for clarity, the present application describes the device as including a vaporization rig (with a nail, a main body, and a mouthpiece), and a support structure. The device may also include a heating element, such as a torch (e.g., a butane torch) or an electric heating element (e.g., coils that generate heat via resistive heating). The support structure houses/receives the heating element and the vaporization rig so that a user can hold and operate the device with one hand. To accomplish this, the support structure supports the heating element in a position that aligns an operative end of the heating element with a nail of a vaporization rig supported by the supported structure. For example, the support structure can position a torch to generate a flame that acts on the nail of a vaporization rig supported by the supported structure. As another example, the support structure can position one or more coils of an electric heating element so that the coils can contact and heat the nail and/or a substance disposed therein.

When the vaporization device includes a torch that generates a flame, the flame acts on the nail to either heat a liquid or wax concentrate disposed in the nail or to heat the nail (so that a wax or liquid concentrate can be placed into a hot nail). Alternatively, if the vaporization device includes an electric heating element (e.g., a coil), the coil can directly contact the nail or the liquid/wax concentrate disposed in the nail to heat the concentrate. In any of these scenarios, since the vaporization device aligns the vaporization rig's nail with heat generated by a heating element (e.g., a flame generated by a torch), the vaporization device allows a user to easily create inhalable vapor from a liquid or wax with a vaporization rig while only using one hand.

Moreover, the support structure allows a user to easily generate this vapor at least because the support structure provides an insulated surface for a user to grasp when heating a nail which, in some instances, may be heated to temperatures near or upwards of 500° F. The device also enhances the safety of a vaporization rig because it positions a heating element (e.g., a torch) without requiring a user to hold the heating element and, thus, prevents injuries (e.g., burns) that may occur if a user loses focus, slips, or otherwise errs while operating a heating element held in their hand.

Figure 9B:
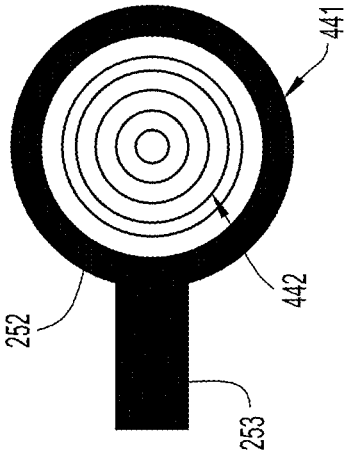
FIG. 9B illustrates a top view of a nail and heating device included in the vaporization device of FIG. 9A.
Figure 9A:
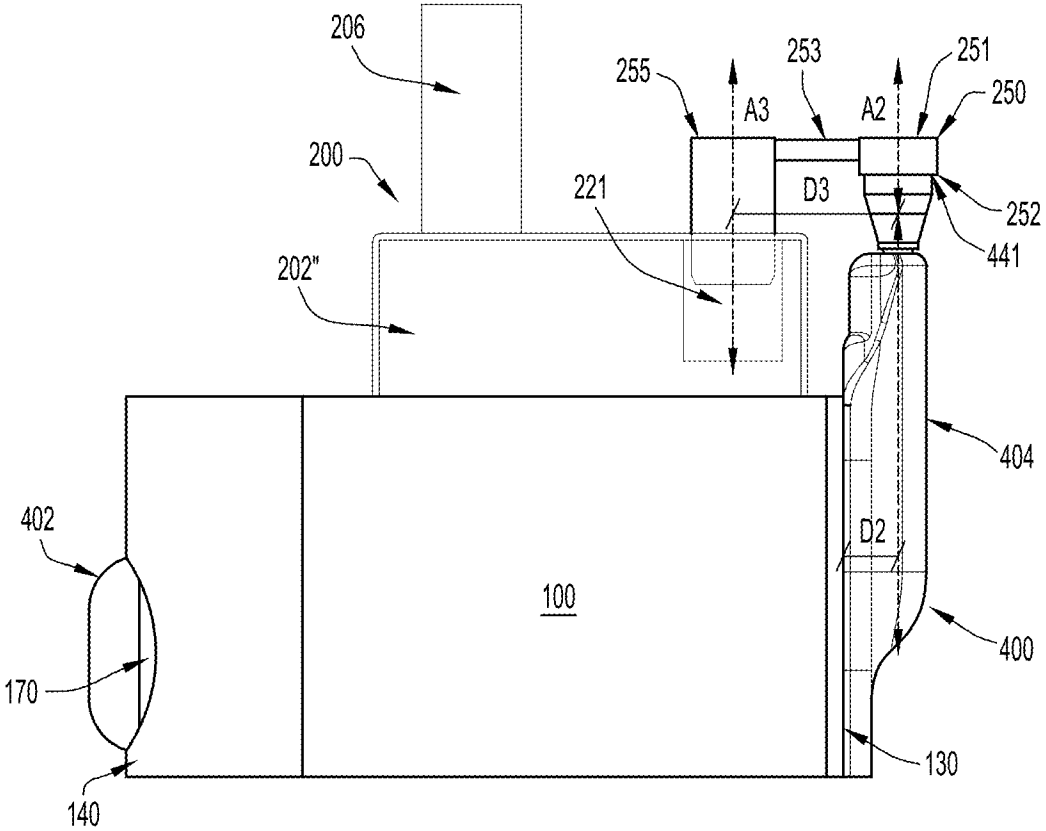
FIG. 9A illustrates a side perspective view of a vaporization device according to an example embodiment of the present invention, the vaporization device of FIG. 9A being formed from many of the components as the vaporization device of FIG. 3C.
Figure 11:
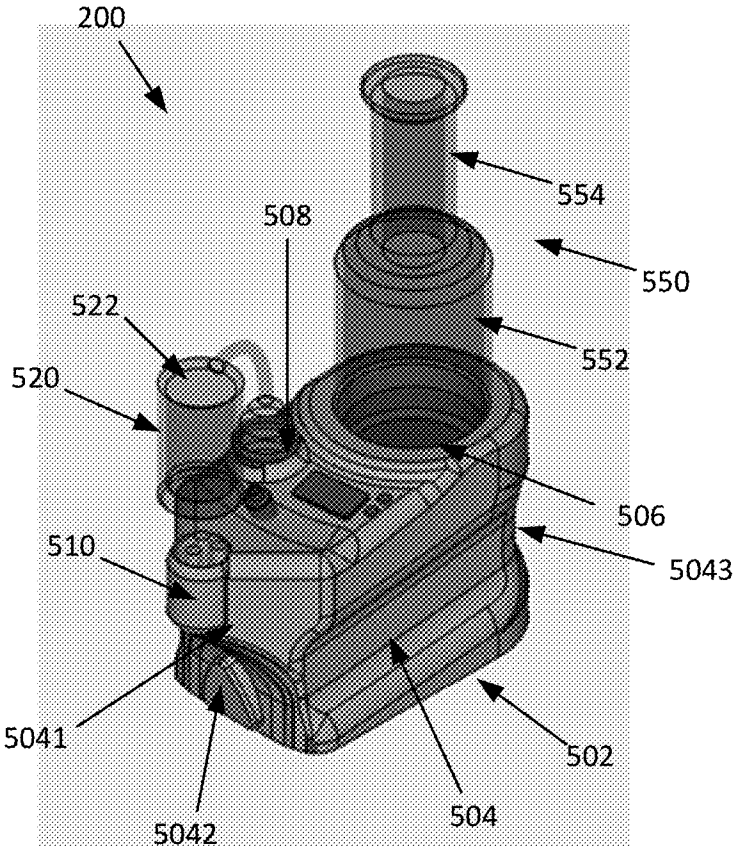
FIG. 11 illustrates a top perspective view of the vaporization device of FIG. 10.
Figure 10:
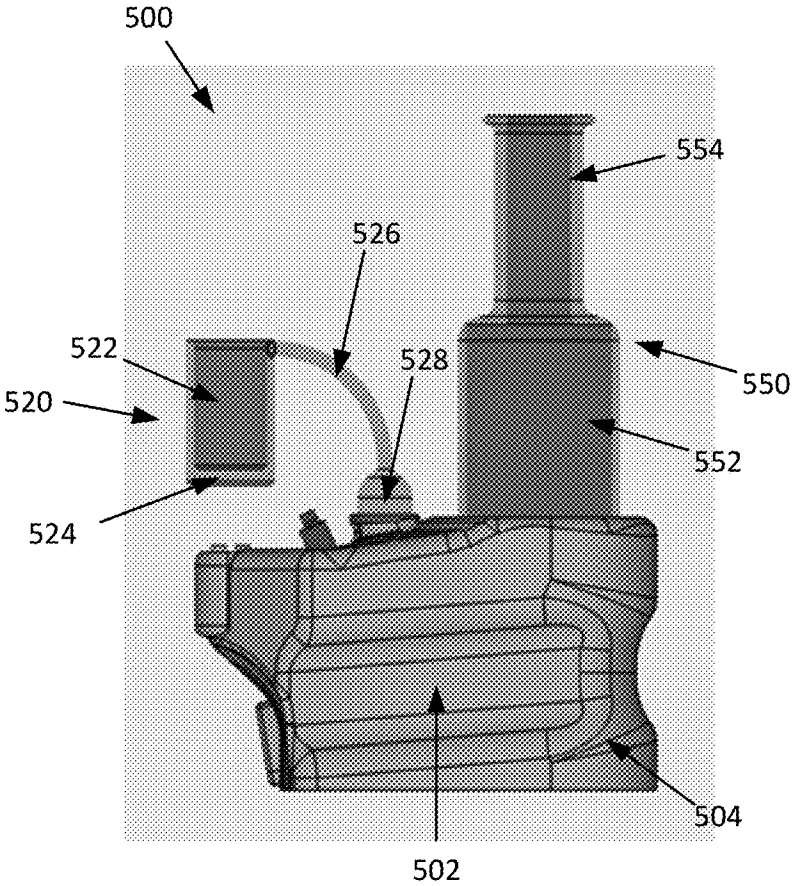
FIG. 10 illustrates a side view of a vaporization device according to another example embodiment of the present invention.

Generally, FIGS. 1-8 and 10-13 illustrate embodiments of the vaporization device presented herein that include a torch that consumes a fuel and generates a flame (e.g., a butane torch). By comparison, FIGS. 9A and 9B illustrate an embodiment of the vaporization device presented herein that includes an electric heating element. Thus, the embodiments illustrated in FIGS. 1-8 and 10-13 are often described in connection with a "torch" and/or "flame." However, it is to be understood that description of many of the elements associated with the embodiments illustrated in FIGS. 1-8 and 10-13 should be applicable to embodiments including an electrical heating element in place of a torch. Moreover, at least the embodiment illustrated in FIGS. 10-13 could include an electric heating element instead of a torch and it is to be understood that any description of a "torch" and/or "flame" in connection with this embodiment is only provided by way of example and is not intended to be limiting in any manner.

Figure 1:
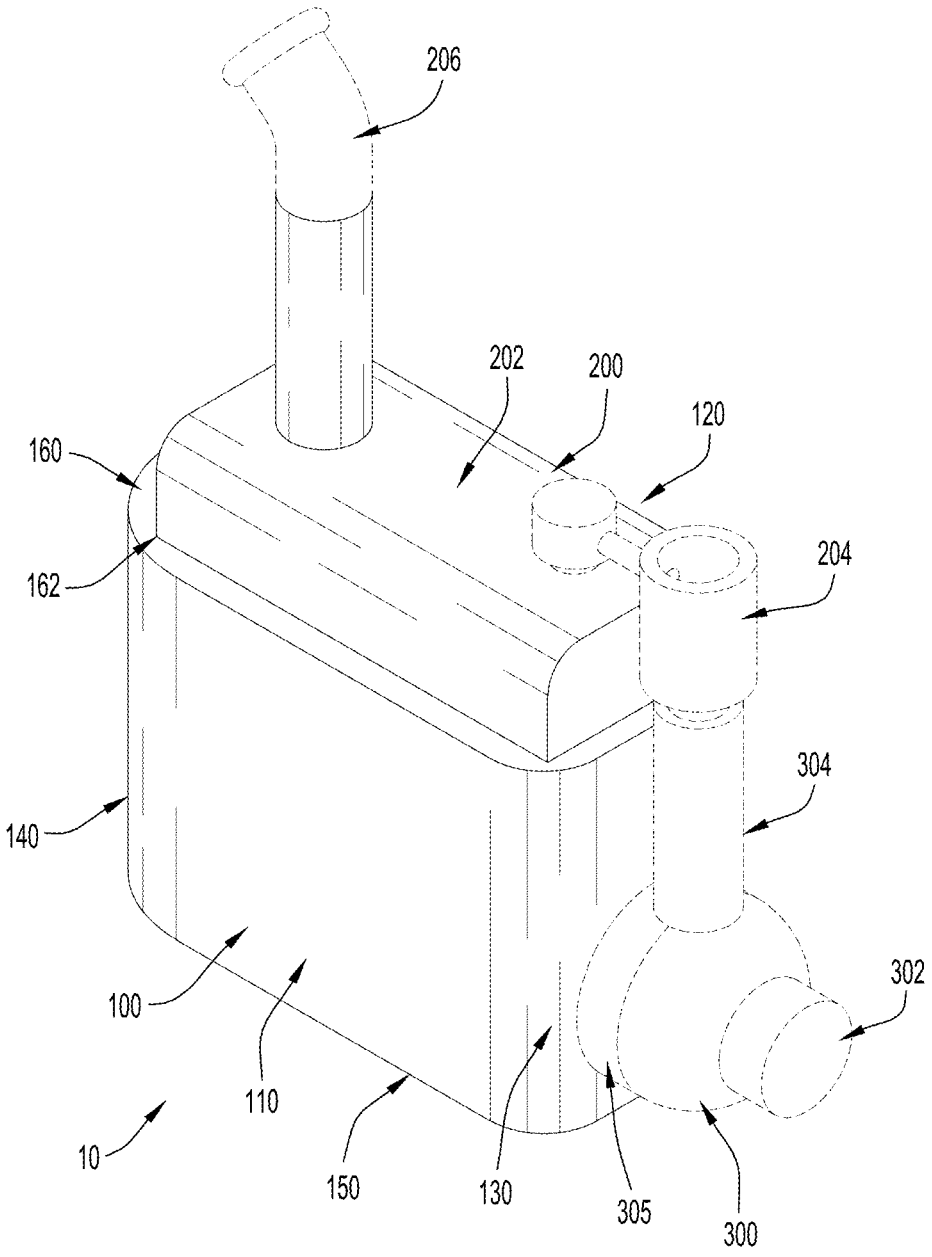
FIG. 1 illustrates a front perspective view of a vaporization device according to an example embodiment of the present invention.
Figure 2:
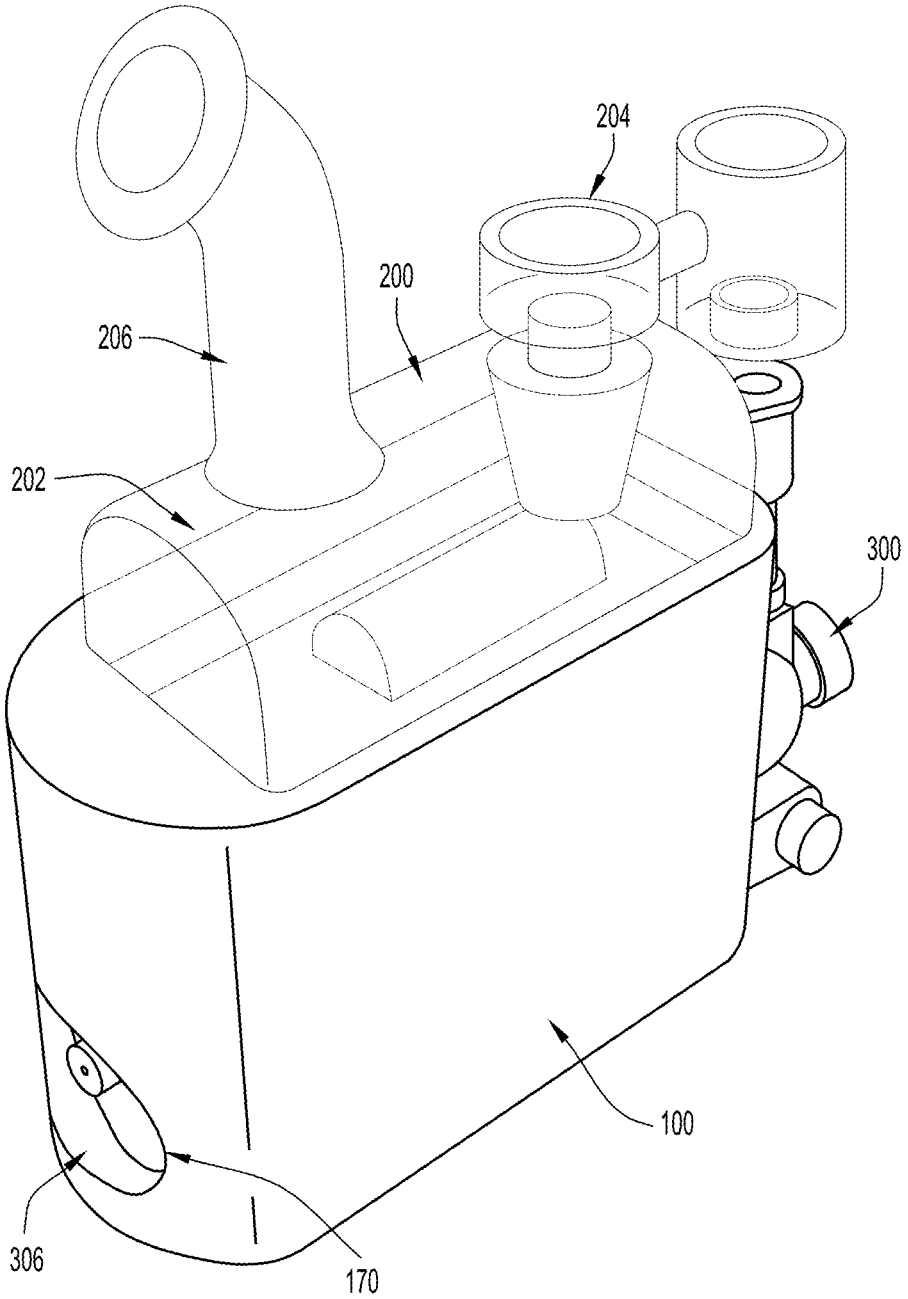
FIG. 2 illustrates a back perspective view of the vaporization device of FIG. 1.
Figure 3A:
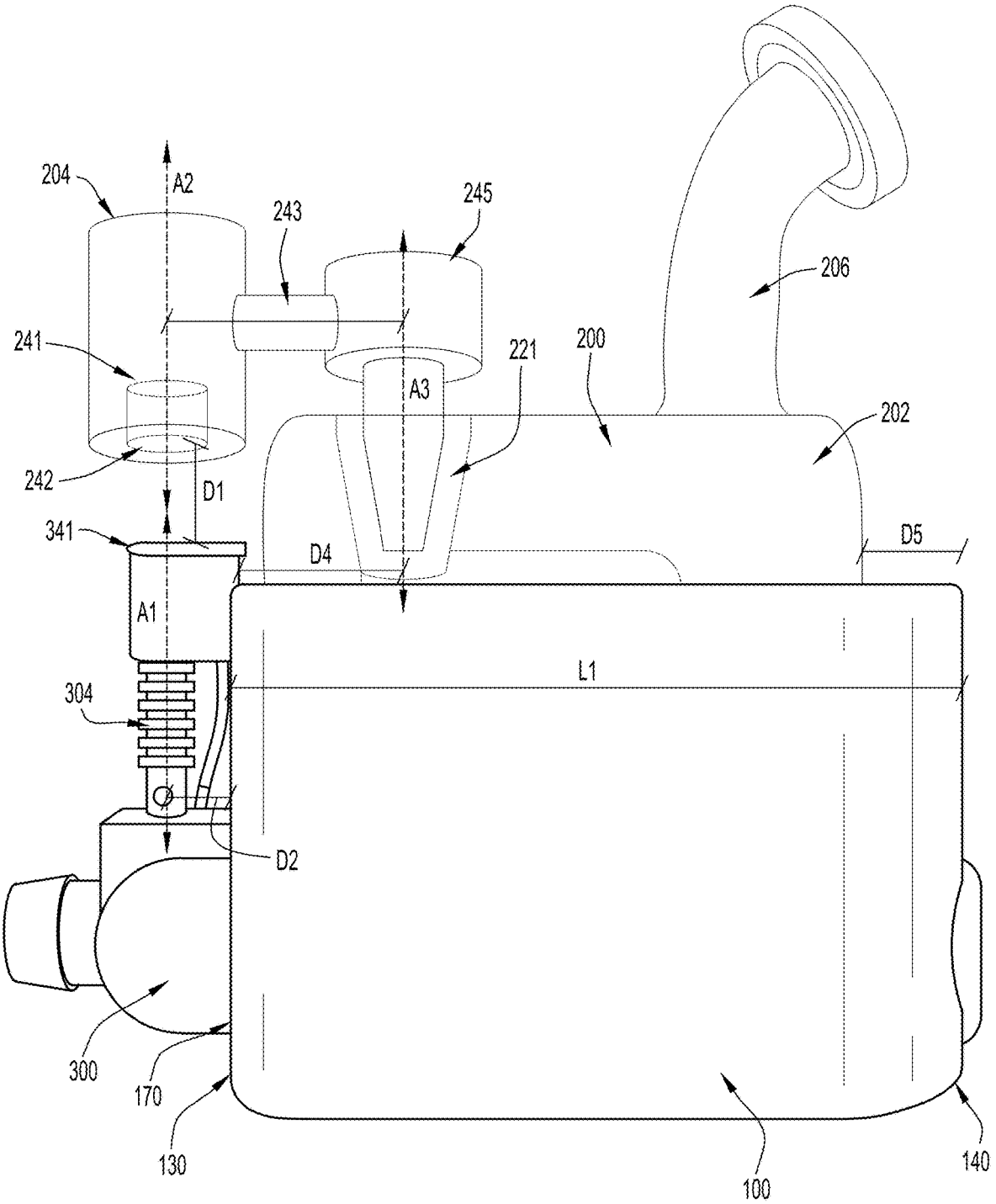
FIG. 3A illustrates a side perspective view of the vaporization device of FIG. 1.
Figure 3B:
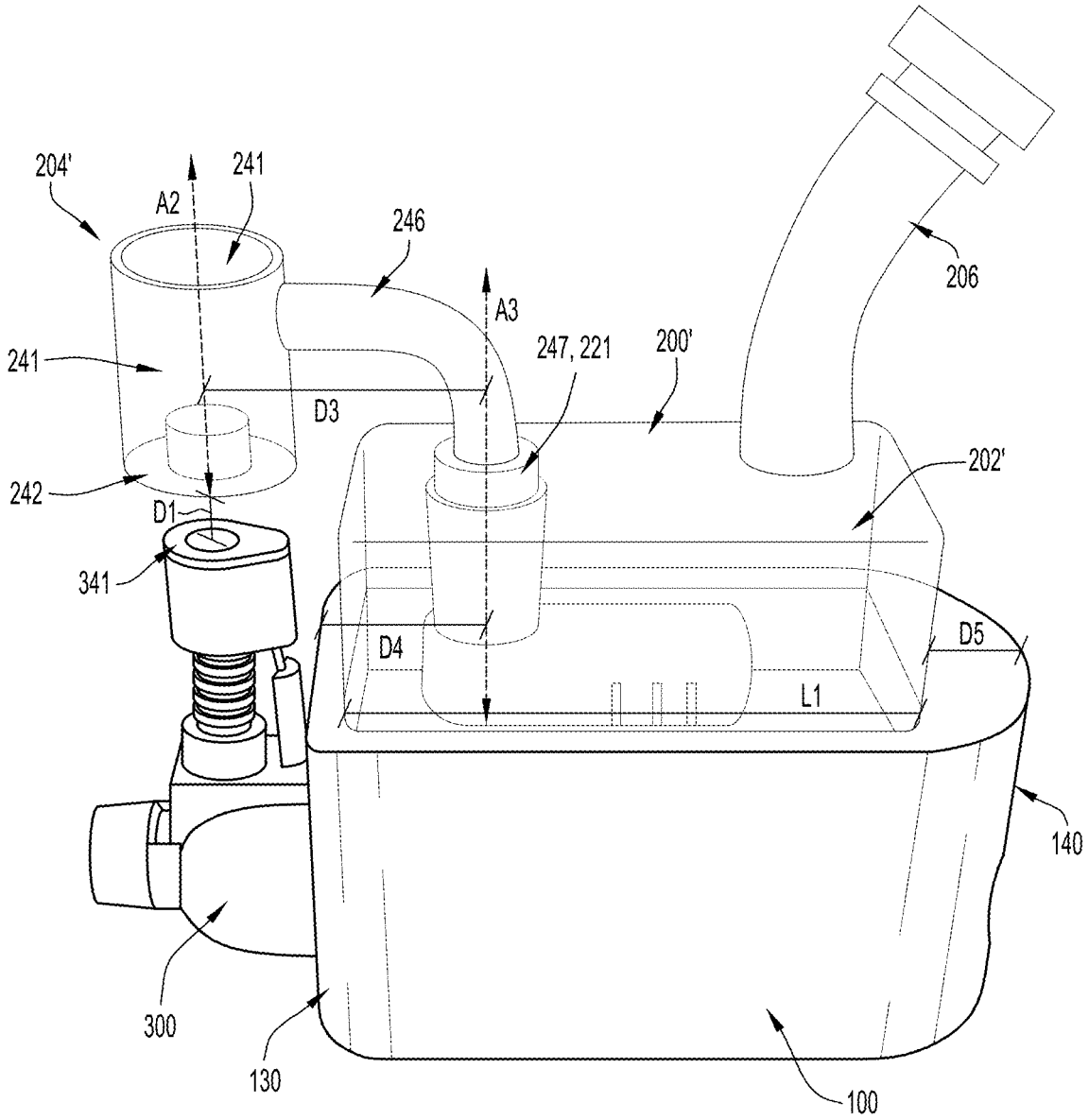
FIG. 3B illustrates a side perspective view of a vaporization device according to an example embodiment of the present invention, the vaporization device of FIG. 3B being formed from many of the components as the vaporization device of FIG. 1.
Figure 3C:
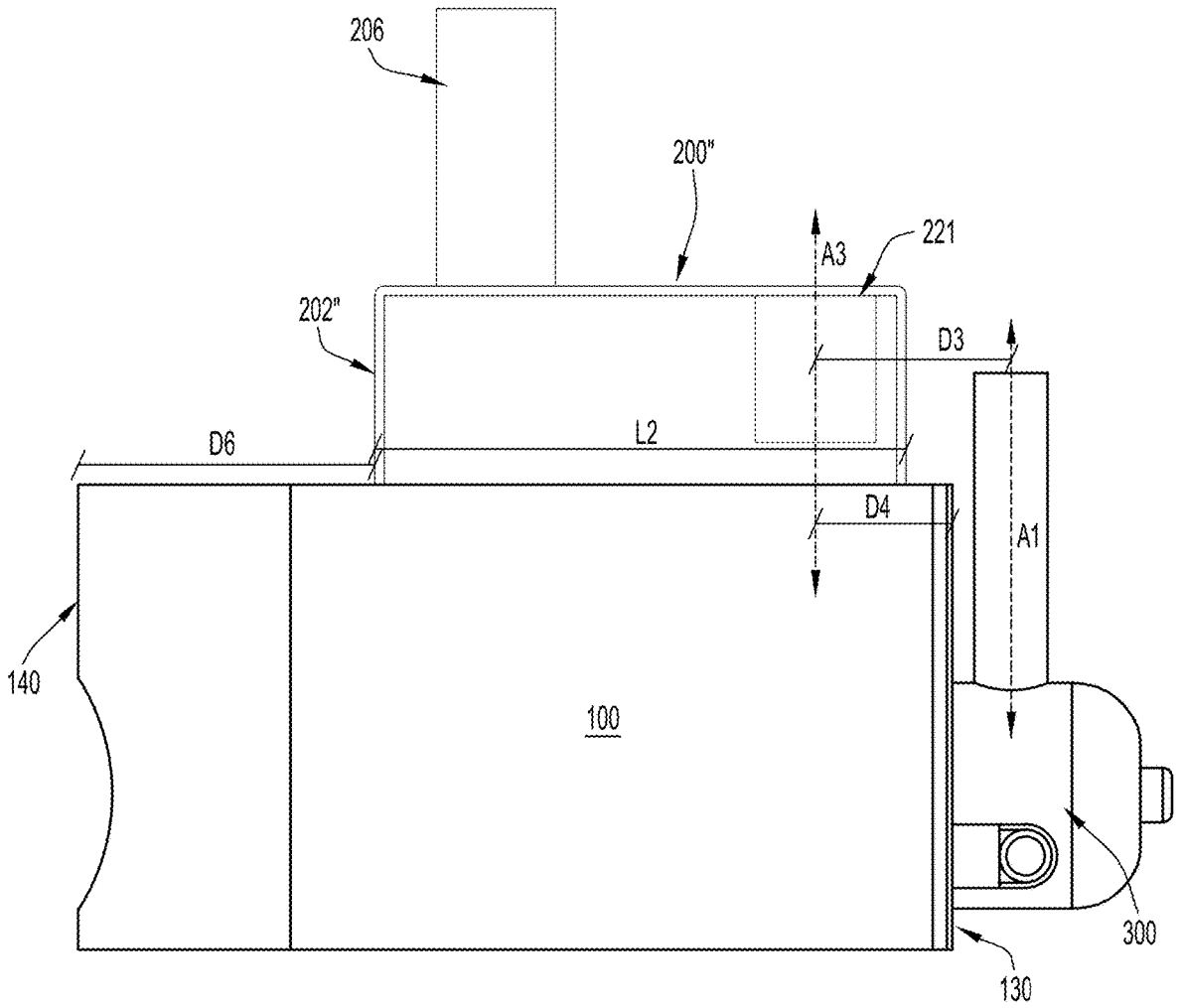
FIG. 3C illustrates a side perspective view of a vaporization device according to an example embodiment of the present invention, the vaporization device of FIG. 3C being formed from many of the components as the vaporization device of FIG. 1.
Figure 4:
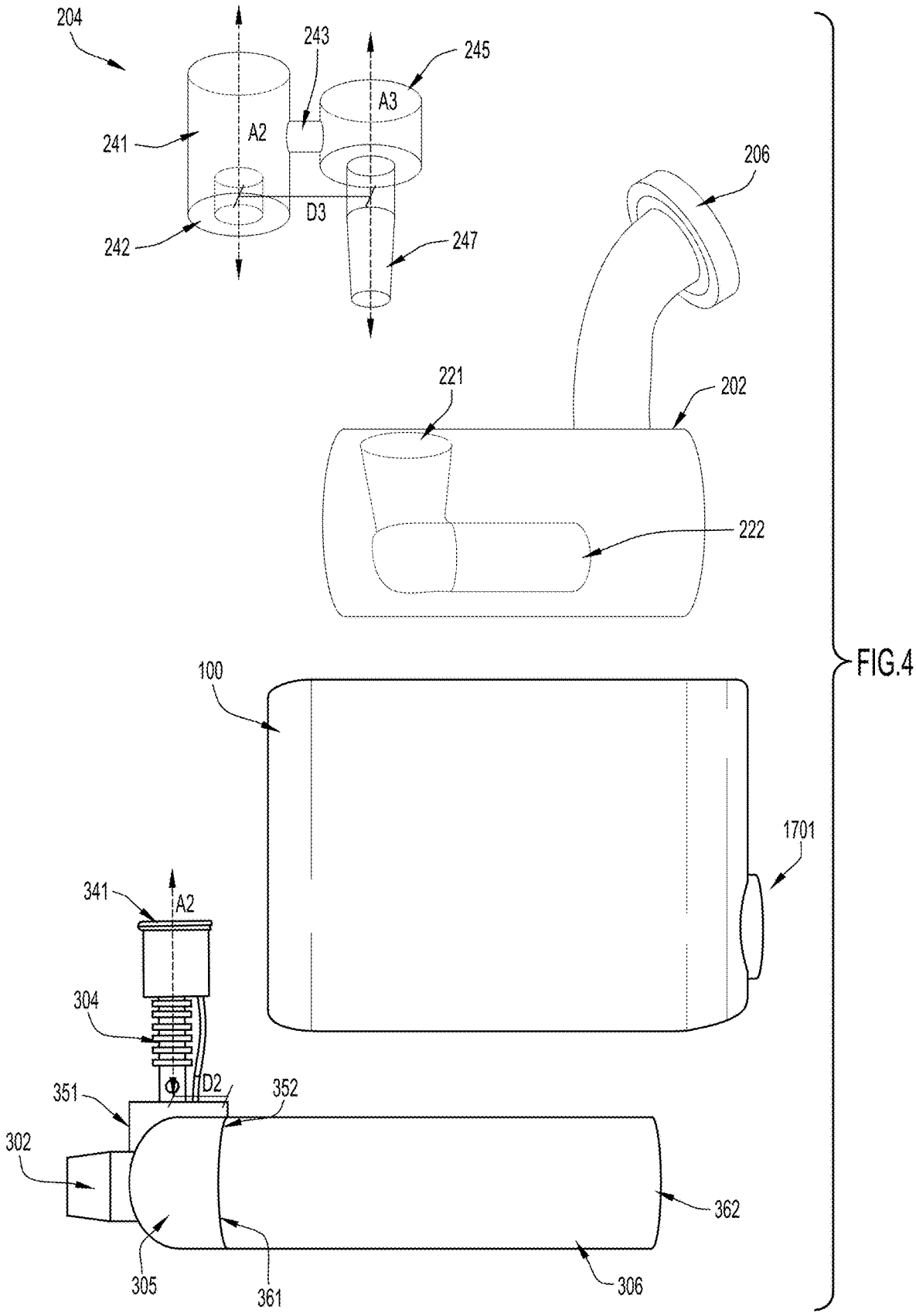
FIG. 4 illustrates a side view of the vaporization device of FIG. 1 while disassembled.

With that in mind, FIGS. 1 and 2 illustrate a vaporization device 10 according to an example embodiment. In this embodiment, the device 10 includes a support structure 100, a vaporization rig 200, and a torch 300. The support structure 100 extends from a first side 110 to a second side 120 and from a front end 130 to a back end 140. Sides 110 and 120, as well as front 130 and back 140, are longitudinally bounded by a top 160 and a bottom 150.

In this embodiment, a hole 170 (shown best in FIG. 8) extends from the front end 130 towards the back end 140 and is sized to receive the torch 300 (or any other heating element) or, more specifically, a tank 306 of a torch 300 (or a battery compartment of an electric heating element, an example of which is described below in connection with FIG. 9A). For example, the hole 170 may have a radius R1 (see FIG. 8) in the range of 5 mm-50 mm, 10 mm-30 mm, for example approximately 15 mm. In the depicted embodiment, hole 170 is parallel to sides 110 and 120 and also extends through the back end 140. That is, hole 170 is a straight, through hole. However, in other embodiments, the hole 170 may have any size or shape suitable to receive a torch 300 (and need not extend through back 140). In fact, as is described below in connection FIGS. 10-13, in some embodiments, the holes 170 may be closed at both ends and may enclose or surround a torch 300. That is, in some embodiments, the support structure 100 may define an enclosed cavity instead of an accessible/open hole 170.

Meanwhile, the top 160 defines a receptacle 162 that is sized to receive at least a portion of a vaporization rig, such as main body 202 of vaporization rig 200. In the depicted embodiment, the vaporization rig 200 includes a main body 202, a removable nail 204, and a mouthpiece 106. However, in other embodiments, the vaporization rig 200 need not include a nail 204. The main body 202 may include a chamber that can (but does not necessarily need) receive water (or some other liquid substance) and may define one or pathways that allow vapor to flow from the nail 204 to the mouthpiece 206 (i.e., so that the mouthpiece 206 is in fluid communication with nail 204). The chamber and pathways may be provided in any manner now known or developed hereafter and are generally denoted at 222 in FIG. 4.

Alternatively, in some embodiments, such as the embodiment depicted in FIGS. 10-13, the support structure 100 may include or define pathways from a nail to a vaporization rig 200 that is formed without a nail. That is, the vaporization rig 200 may not include a nail, but may be fluidly coupled, via the support structure 100, to a nail provided independently of the vaporization rig 200. Or, from a different perspective, in some embodiments the vaporization rig 200 need not be formed separately from the support structure 100 and the support structure 100 may form a portion of the vaporization rig 200 (e.g., to connect a nail to a rig). An example of such an arrangement is discussed in further detail below in connection with FIGS. 10-13.

Still referring to FIGS. 1 and 2, but now with reference to FIGS. 3A-3C and 4 as well, in various embodiments, the main body 202 may have different shapes or sizes. For example, in the embodiment depicted in FIGS. 1-3A and 4, the main body 202 is substantially rounded at each of its edges and corners, but in the embodiments depicted in FIGS. 3B and 3C, main bodies 202' and 202" are more cuboidal (also shown in FIGS. 7C and 9A). That is, main bodies 202' and 202" have harder or more defined edges than main body 202. As another example, in both of the example embodiments depicted in FIGS. 1-3A, 3B, and 4, the main body 202 has a length L1, but in the embodiment depicted in FIG. 3C, main body 202" has a length L2 that is substantially shorter than L1. In still further embodiments, a vaporization rig need not be cuboidal and can have any other shape, such as a cylindrical shape (an example of which is shown in FIGS. 10-13).

In some instances, different embodiments of support structure 100 may include receptacles 162 of different sizes so that each embodiment can receive and secure a main body 202, 202', 202" of a different size or shape. Alternatively, the support structure may include more than one receptacle to receive different pieces of a vaporization rig, a vaporization rig and a nail, or any other combination of parts. Still further, regardless of the number of receptacles included in the support structure 100, the support structure 100 and/or the vaporization rig 200 can include features (e.g., grip members) that allow vaporization rigs 200 of different sizes and shapes to be securely installed into the same support structure 100. In fact, regardless of the differences in the shapes and sizes described above, the support structure 100 will still align the nail 204 of a vaporization rig 200 with a heating element 400 installed in the support structure 100. This is because the changes in shape and size do not alter a distance D4 between a central vertical axis A3 of a receiver 221 of the main body 202 and a front end 130 of the support structure 100.

For example, altering the shape of the edges/corners does not move the receiver 221 with respect to front end 130. Meanwhile, when the overall length of the main body is shortened from L1 to L2 (e.g., from main body 202 or 202' to main body 202"), the distance between a back end of the main body 202 and the back end 140 of the support structure increases from distance D5 to D6 while the distance D4 between a central vertical axis A3 of a receiver 221 of the main body 202 and a front end 130 of the support structure 100 is unchanged. That all said, in other embodiments, the shape or size of the vaporization rig might change the distance D4, but the dimensions of the nail 204 can be altered to ensure that the support structure 100 still aligns the nail 204 with a heating element 400 installed in the support structure 100.

Still referring to FIGS. 1-4, in the depicted embodiments, the nail 204, which may also be referred to herein as the heatable portion of the vaporization rig, includes a liquid/wax receptacle 241 that can receive an inhalable substance, such as a liquid or wax concentrate. As is shown in at least FIGS. 3A and 4, in some embodiments, the receptacle 241 may be connected, via a neck 243, to a vapor chamber 245 and the vapor chamber 245 may include a mount 247 that can sit within a receiver 221 in the main body 202 of the vaporization rig 200. Alternatively, in some embodiments, the nail receptacle 241 may be connected directly to mount 247 via a curved neck 246 that replaces the neck 243 and vapor chamber 245, as is shown in FIG. 3B. Notably, a nail with a curved neck 246 may reduce the number of joints in the nail 204 as compared to a nail with a neck 243 and vapor chamber 245 and, thus, may provide added structural integrity as compared to a nail with a neck 243 and vapor chamber 245.

Regardless of the number of joints in a nail of the vaporization rig, the mount 247 of the nail 204 may be removably installed or permanently coupled to the receiver 221 of the main body 202. Alternatively, a nail might include a mount that can be removably installed or permanently coupled to a support structure of the vaporization device. Either way, when the mount 247 installed in the receiver 221 or a corresponding receptacle of the support structure, the mount 247 operably connects the nail 204 to the body 202 (either directly or via a pathway defined in the main body 202), insofar as the term "operably connect" is used to describe a sealed connection that allows vapor to flow between components. In any of these instances, a removable nail 204 may be easier to transport and use.

Now turning to FIGS. 3A-C and 4, as mentioned, the support structure 100 of the device 10 presented herein positions the torch 300 to generate a flame that acts on the nail 204 of a vaporization rig 200 supported by the support structure 100. In this particular embodiment, the receptacle 162 and the hole 170 combine with the rig 200 and torch 300 to provide this alignment. In particular, the hole 170 is configured to receive the tank 306 of torch 300, but the torch 300 also includes a housing 305 that defines a stop 351 that extends beyond the perimeter of the hole 170. Thus, the stop 351 aligns a back end 352 of the housing 305 with the front end 130 of the support structure 100 when the torch 300 is installed in (e.g., slid into) hole 170. Consequently, a central axis A1 of the flame guide 304 (i.e., a heat generating portion of torch 300) is consistently positioned at a distance D2 from the front end 130 when the torch 300 is installed in the support structure 100. That is, the torch 300 includes a housing 305 that acts as a stop to control the distance the torch 300 protrudes beyond the hole 170 (e.g., at the front end 130) so that the flame guide 304 (i.e., the heat generating portion) is disposed a specific distance lateral beyond the front 130 (which is the same distance the nail 204 extends).

Meanwhile, the receptacle 162 in the support structure 100 and the receiver 221 in the vaporization rig 200 position the nail 204 so that a central axis A2 of the liquid/wax receptacle 241 is also positioned the distance D2 from the front edge 130 of the support structure 100. To effectuate this, the receiver 221 of the body 202 is approximately 7 mm from a front edge (the edge at the left of FIG. 3A) of the rig 200 and the neck 243 of the nail 204 extends a distance of approximately D3 between a central axis A2 of the liquid/wax receptacle 241 and a central axis A3 of the a vapor chamber 245. In the depicted embodiment, distance D3 is the sum of: (1) the width of the front end 130; (2) the distance D2; and (3) the distance between receiver 221 and the front of the main body 202 (e.g. approximately 7 mm or, alternatively, a distance in the range of approximately 2 mm to approximately 19 mm or approximately 5 mm to approximately 9 mm). Consequently, in the depicted embodiment, the device 10 aligns the liquid/wax receptacle 241 with the flame guide 304, so that axis A1 is collinear with axis A2. In at least some embodiments, D3 may be in the range of approximately 12 mm to approximately 100 mm, the range of approximately 25 mm to approximately 75 mm, such as approximately 50 mm (insofar as approximately includes a range of 1 mm in either direction).

However, in other embodiments, axis A1 and A2 need not be collinear and, instead, may be offset and/or askew, provided that the flame guide 304 still directs a flame at the bottom 242 of the liquid/wax receptacle 241. For example, axis A1 may be offset from axis A2 by a distance in the range of approximately 1 mm to approximately 20 mm in either direction, approximately 1 mm to approximately 10 mm in either direction, approximately 1 mm to approximately 5 mm in either direction or may be substantially aligned (i.e., less than approximately 1 mm in either direction). However, it has been found that when the vaporization rig 200 includes a torch, an inward offset of axis A1 with respect to axis A2 may provide better performance than an outward offset of axis A1 with respect to axis A2 at least because a flame may tend to angle or bend away from the support structure 100. Thus, an inward offset may still properly heat the nail 204, but an outward offset may not and might also create a burn risk for the user (since the flame might extend beyond the nail 204).

Moreover, in other embodiments, the torch 300 and rig 200 can be reversed with respect to the support structure 100 (e.g., rotated 180 degrees about a vertical axis with respect to the support structure 100) and may extend a distance beyond the back end 140 of the support structure. For example, in the depicted embodiment, the distal end 362 of the torch tank 306 is inserted into the hole 170 at the front end 130 of the support structure and is aligned with the back end 140 once installed in the hole 170 (while a proximal end 361 of the torch tank 306 is aligned with the front end 130). But, in other embodiments the proximal end 361 of the torch tank 306 may be inserted into the hole 170 at the back end 140 of the support structure 100 and may be aligned with the front end 130 once installed in the hole 170 (while the distal end 362 of the torch tank 306 is aligned with the back end 140). In the latter embodiments, the rig 200 can be installed in the support structure 100 in a reversed or flipped arrangement, so that the nail 204 extends beyond the back end 140 of the support structure 100.

As is discussed in further detail below, the front end 130 and the back end 140 of the support structure 100 may have different shapes in order to support nails 204 and/or torches 300 with different configurations. That said, some embodiments may allow a user to reposition the torch 300 and rig 200 at will, while other embodiments may include features that limit the positions in which the torch 300 and rig may be installed in the support structure 100. For example, the support structure 100 may include an end cap 1701 (see FIG. 4) that prevents a torch 300 from being inserted into one end of the hole 170. The cap 1701 may be fixed to ensure that a user cannot install a torch 300 into the support structure 100 from a particular side or may be removable and may be used as an installation indicator and/or another stop (e.g., in addition to stop 351).

Still referring to FIGS. 3A-C and 4, the device 10 presented herein not only laterally aligns the nail 204 with the flame guide 304 of the torch 300 (as described in the foregoing paragraphs), but also arranges these components to be disposed an optimal longitudinal distance away from each other. The longitudinal (e.g., vertical) spacing D1 between the flame guide 304 and the nail 204 ensures that the torch 300 can efficiently heat the nail 204 without excessively heating (e.g., burning) a nail 204 or components disposed therein. For example, in the depicted embodiment, a top 341 of the flame guide 304 is positioned approximately 13 mm below a bottom 242 of the wax/liquid receptacle, but in other embodiments the distance D1 is in the range of approximately 6 mm to approximately 25 mm or approximately 12 mm to approximately 19 mm. This is due to the position of the hole 170 in the support structure 100, the dimensions of the rig 200, and the dimensions of the receptacle 162 in the support structure 100.

In the depicted embodiment, the rig 200 and the receptacle 162 are sized so that the main body 202 sits approximately 20 mm below the top edge 160 of the support structure 100. That is, the receptacle 162 has a depth of approximately 20 mm. The other dimensions of the receptacle 162 may be sized to mate with the rig 200. For example, the rig may have a length L1 of approximately 90 mm and a width of approximately 45 mm and the receptacle 162 may have a length and width sized to frictionally receive the length and width of the rig 200. Meanwhile, the hole 170 is positioned a distance D8 (see FIG. 8) below the top edge 160 so that the top 341 of the flame guide 304 may be the distance D1 (examples of which are described above) below the bottom 242 of the liquid/wax receptacle.

Figure 5:
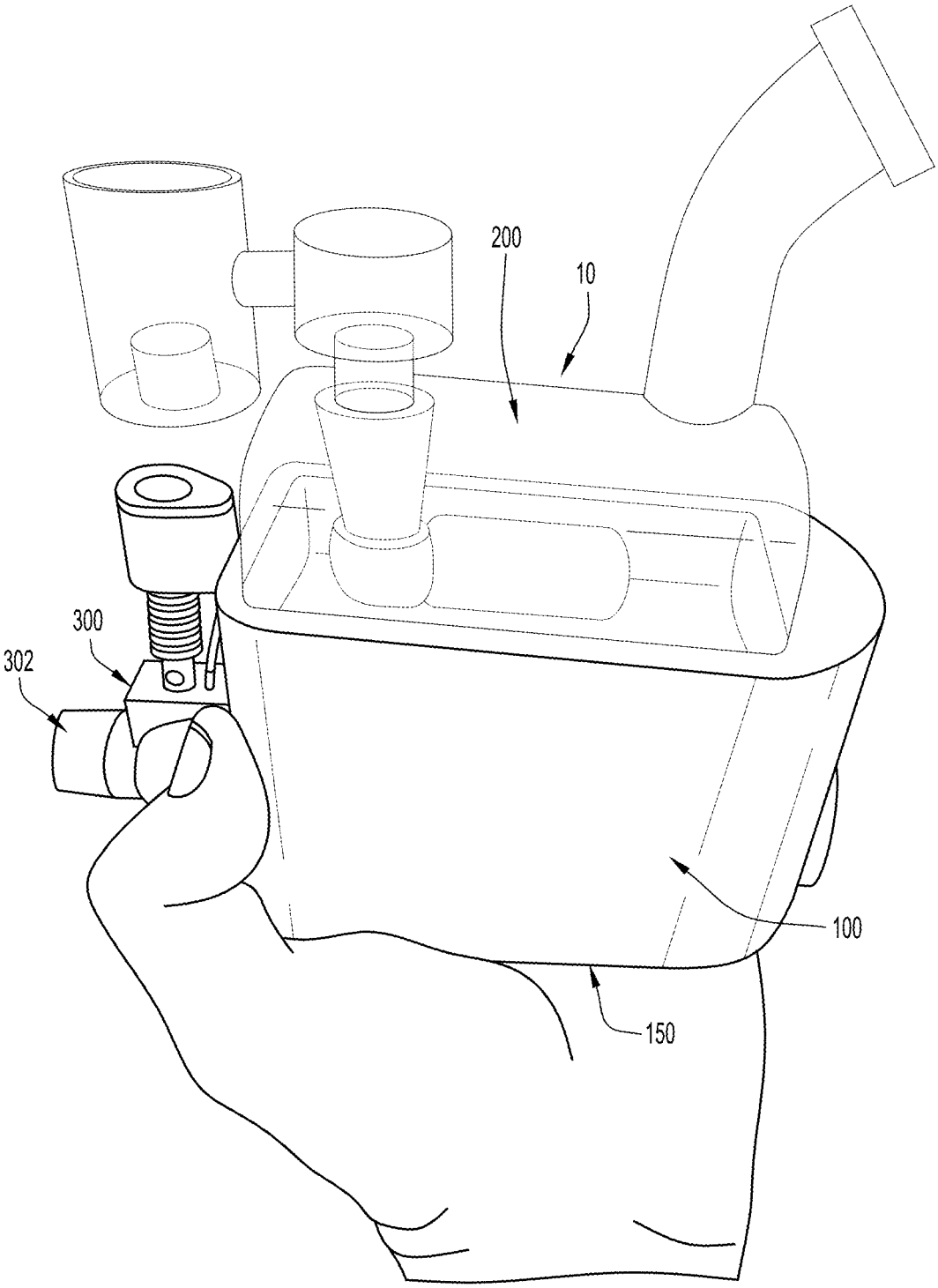
FIG. 5 illustrates a side perspective view of the vaporization device of FIG. 1 while being held in a user's hand.

FIG. 5 shows the device 10 being held by a user in one hand. Notably, when the user holds the device 10, the user primarily grips the support structure around its bottom 150 and the support structure naturally aligns the user's thumb with an actuator 302 included on the torch 300. The user's hand does not contact the rig 200 and, thus, a user is unlikely to burn their hand as the rig 200 is heated nor when/if rig 200 heats up. The support structure 100 may have any size that allows a user to easily and comfortably grip the device 10. For example, in the depicted embodiment, the support structure 100 may have a length (e.g., the dimension spanning the width of the user's hand) of approximately 114 mm and a width (e.g., the dimension extending into the page in the view shown in FIG. 5) of approximately 55 mm.

Figure 6:
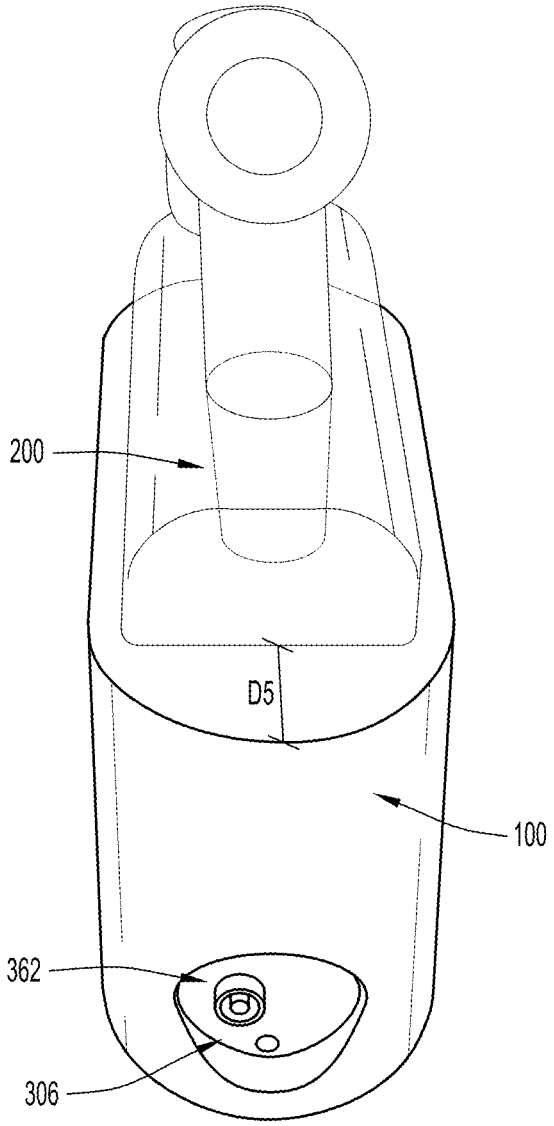
FIG. 6 illustrates a top, back perspective view of the vaporization device of FIG. 1.
Figure 7B:
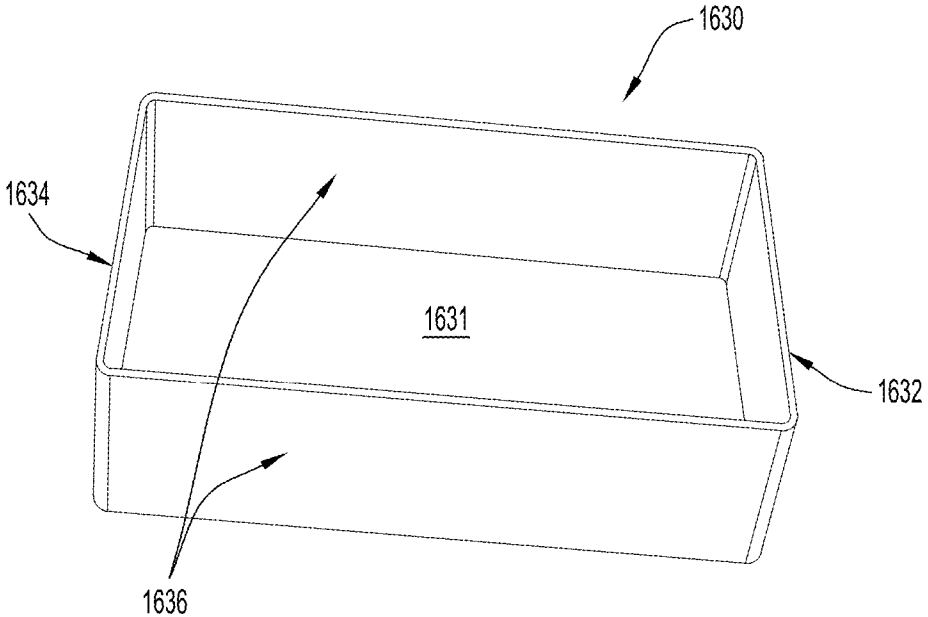
FIG. 7B illustrates a top perspective view of a support structure included in the vaporization device of FIG. 3B.
Figure 7A:
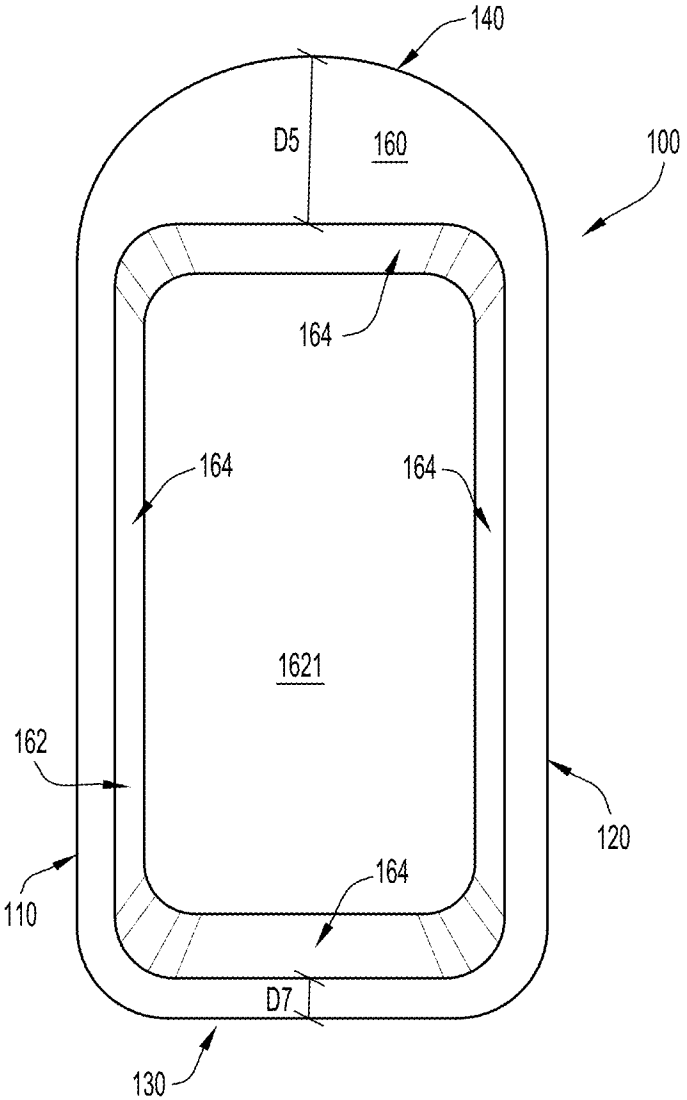
FIG. 7A illustrates a top view of a support structure included in the vaporization device of FIG. 1.

FIG. 6 shows a top perspective view of the support structure 100 with the rig 200 and FIG. 7A shows a top view of the support structure 100 with the rig 200 removed. Thus, FIGS. 6 and 7A clearly show the different shapes/dimensions of the front end 130 and the back end 140, The front end 130 is substantially flat and, thus provides minimal separation (denoted by distance D7) between the receptacle 162 and the front end 130 of the support structure 100. Meanwhile, the back end 140 is rounded and, thus provides significantly more distance (denoted by distance D5) between the back end 140 and the receptacle 162 than is provided between the receptacle 162 an the front end 130. That is, distance D5 is larger than distance D7. Thus, if a user has a nail 204 with a neck that is significantly longer than the neck 243 shown in the depicted embodiment (e.g., D3 is longer than the D3 shown in the depicted embodiment), the support structure 100 can still be used with that nail 204 (by flipping or reversing the orientation of the torch 300 and rig 200) without exposing too much of the torch 300 (notably, if the torch 300 is extending too far beyond the support structure 100 it might become unstable, which is unsafe).

Now referring to FIG. 7A alone, this figure illustrates the receptacle 162. In the depicted embodiment, the support structure includes a grip member 1621 positioned at a bottom of the receptacle 162 (i.e., on a bottom surface). In fact, in the depicted embodiment, the grip member 1621 is fixedly coupled to the bottom surface of the receptacle 162. Meanwhile, the walls 164 forming the receptacle 162 are approximately vertical, with rounded corners extending therebetween. As mentioned, the walls 164 are sized to frictionally secure the main body 202 of the rig 200 in the receptacle 162 and the group member 1621 may enhance this frictional engagement. That is, the grip member 1621 may have a higher coefficient of friction than the material used to manufacture the support structure 100 (e.g., resin) and, thus may increase the strength of friction between the support structure 100 and the vaporization rig 200.

Figure 7C:
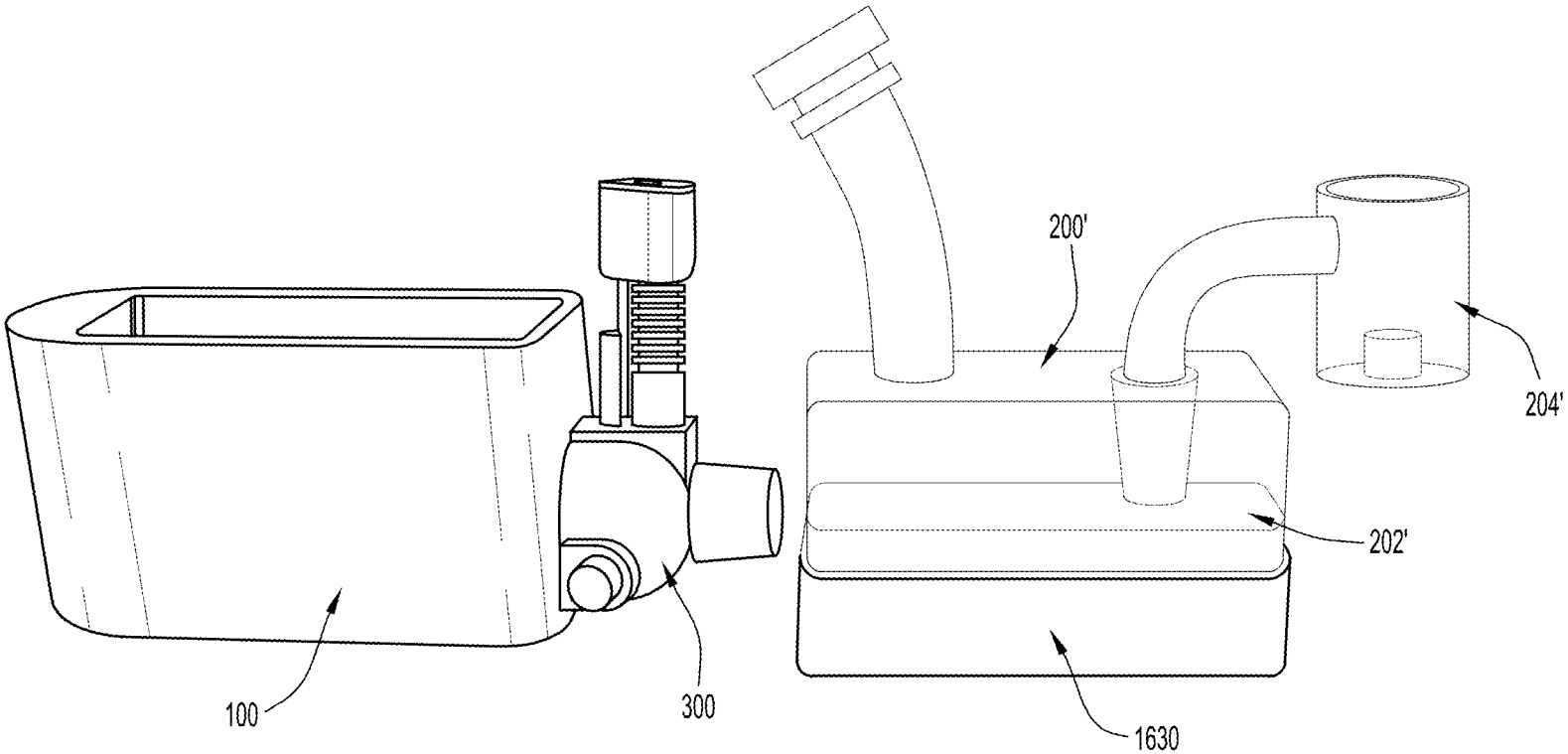
FIG. 7C illustrates a side view of the vaporization device of FIG. 3B while partially disassembled.
Figure 8:
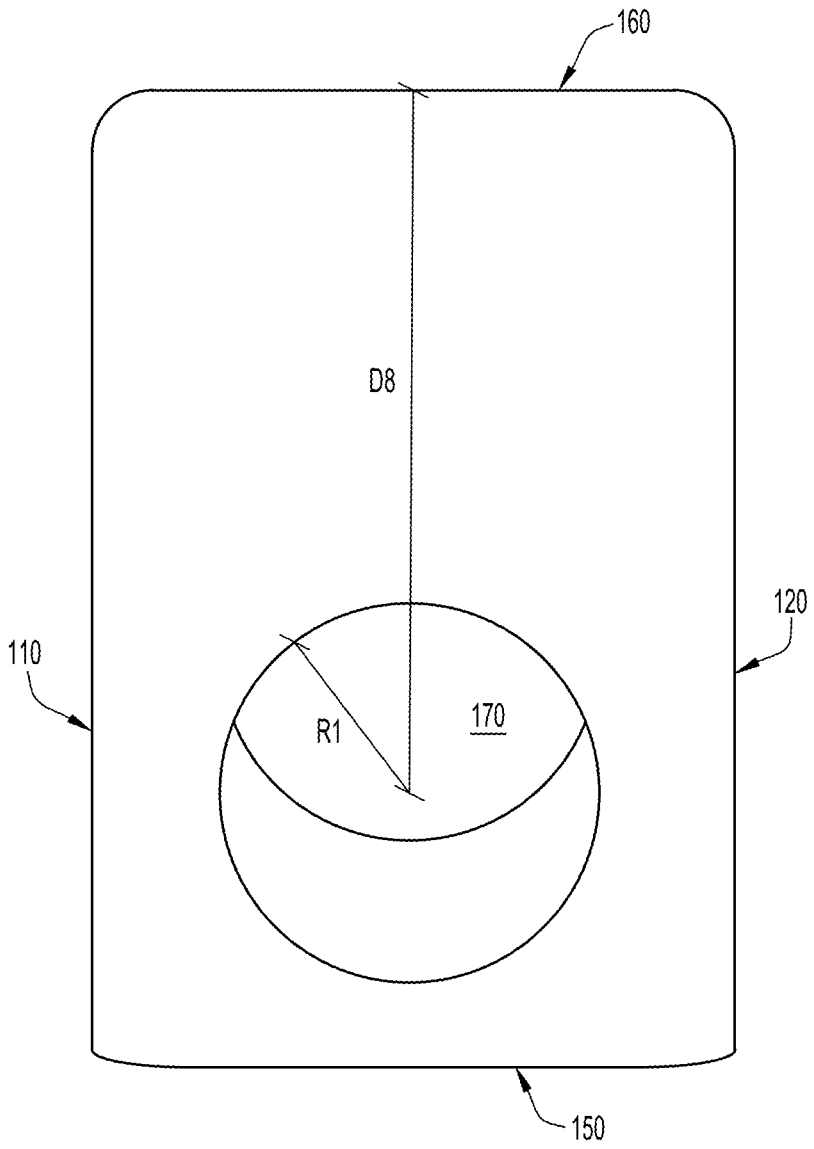
FIG. 8 illustrates a back view of the support structure of FIG. 7.

FIG. 7B illustrates another embodiment of a grip member that can increase the friction between the support structure 100 and the vaporization rig 200. Grip member 1630 is configured as a sleeve or receptacle and, thus, includes a front wall 1632, a back wall 1634, side walls 1636 and a bottom 1631 that may line the walls 164 and the bottom of the receptacle 162 (i.e., wrap around). In some embodiments, grip member 1630 may be installed in the receptacle 162 (removably or fixedly) and may grip or secure a vaporization rig 200 inserted therein. Alternatively, grip member 1630 may be installed around a bottom section of the main body of the vaporization rig 200, such as the substantially cuboidal main body 202 (removably or fixedly), as is shown in FIG. 7C. Grip member 1630 may be particularly helpful in securing a main body, such as main body 202', within the receptacle 162 of the support structure, because vaporization rigs are typically manufactured from glass (e.g., blown) and, thus, may not always have consistent dimensions. Grip member 1630 may reduce the tolerance requirements of the main body 202 and the support structure 100 and ensure that inconsistent glass dimensions do not prevent the support structure 100 from securely supporting the vaporization rig 200.

Now turning to FIGS. 9A and 9B, these Figures illustrate an embodiment of the vaporization rig presented herein that includes an electric heating element 400 and a hollow nail 250 formed from a synthetic compound (e.g., silicone). The electric heating element 400 is shaped similar to the torch 300 so that the spacing between the torch 300, support structure 100, and vaporization rig 200 discussed above (e.g., in connection with at least distances D2 and D3) is also applicable to electric heating element 400. For brevity, only differences between the embodiments shown in FIGS. 1-8 and the embodiment shown in FIGS. 9A and 9B are described below and any description of like parts or dimensions included above is to be understood to apply to the embodiment shown in FIGS. 9A and 9B.

For example, heating element 400 includes a battery compartment 402 that is shaped similar to tank 306, and, thus, the relationship between heating element 400 and hole 170 is not discussed at length herein. Similarly, heating element 400 includes a support section 404 that houses electronics and laterally positions a central vertical axis A1 of heating element at a distance D2 from the support structure 100 so that axis A1 aligns with a central vertical axis A2 of a nail 250 (which is described below) and, thus, is not discussed at length herein. By comparison, the heating element 400 does not provide a longitudinal distance D1 between a heat generating portion 441 of the heating element 400 and the nail 250 and, thus, is described below.

More specifically, in this embodiment, the nail 250 includes a hollow receptacle 251 and the heating element 400 defines a bottom of the nail 250 when the nail 250 and the heating element 400 are installed in the support structure 100. That is, the distance D1 defined above is approximately zero and the nail 250 includes an open bottom that may be closed or at least partially closed (e.g., defined in part) by the heat generating portion 441 of the electric heating element 400. Then, when an inhalable substance (e.g., a wax or concentrate) is placed in a central opening 252 defined by the hollow receptacle 251, the inhalable substance (e.g., a wax or concentrate) is placed directly onto coils 442 included in the heat generating portion 44*l* and can be heated via convective heating. As the substance is heated, any vapor created via heating of the substance can travel through neck 253 and chamber 255 to the main body 202" (and eventually the mouthpiece 206) of the vaporization rig 200. However, this is just an example and, in other embodiments, the coils 442 could inductively heat an inhalable substance (e.g., a wax or concentrate) placed in a central opening 252, either in addition to or as an alternative to conductive heating. Moreover, in other embodiments, nail 250 can be any shape or size and/or include any features discussed herein (e.g., a curved neck instead of a neck and a chamber).

Now turning to FIGS. 10-13, these Figures illustrate another example vaporization device formed in accordance with principles of the present application. As has been alluded to, in this embodiment, the vaporization device 500 includes a support structure 502 configured to receive a vaporization rig 550 while a heating element 600, such as a torch, is at least partially enclosed within or built into the support structure 502. More specifically, support structure 502 includes a main body 504 that includes a top 505 and extends from a front end 5041 to a back end 5043. The support structure 502 is similar to support structure 100 because a first receptacle 506 (i.e., rig receptacle 506) disposed in the top 505 of the main body 504. The first receptacle 509 is configured to receive a vaporization rig 550, or at least a portion thereof. However, now, a second receptacle 508 (i.e., nail receptacle 508) is also disposed in the top 505 of the main body 504. The second receptacle 508 can receive and support a nail 520 independently form the vaporization rig 550.

Notably, receptacle 506 and 508 are separate and spaced apart because, in this embodiment, the nail 520 is not directly coupled to the rig 550. Instead, the nail 520 is operatively coupled to the rig 550 via the support structure 502. Thus, rig 550 may be sometimes be referred to as a nail-less rig 550 or water pipe 550. Alternatively, the rig 550 and the nail 520 might be collectively referred to as a rig or rig assembly. As yet another alternative, in some embodiments, the rig 550 might only include a mouthpiece and, thus, in some instances, may be referred to as mouthpiece 550.

However, aside from the manner in which nail 520 connects to rig 550, nail 520 may be substantially similar to the nails 204 and 204' shown and described herein in connection with FIGS. 1-9. Thus, any description of nails 204 and 204' should be understood to apply to nail 520. For example, nail 520 includes a receptacle 522 that can receive an inhalable substance, such as a liquid or wax concentrate, similar to receptacle 241. Likewise, nail 520 includes a bottom 524 configured to align with and be heated by a heating element included vaporization device 500 (like bottom 242) and a neck 526 (like neck 246) that operatively connects the receptacle to a mount 528 (like mount 247). However, now, the mount 528 operatively connects, removably or irremovably, the nail 520 to the support structure 502, and specifically to a passageway 514 formed in the support structure 502, instead of a main body of a vaporization rig (e.g., main body 202 of rig 200).

Meanwhile, the vaporization rig 550 may appear substantially different from the vaporization rig 200 of previously described embodiments, but may function similarly to at least the main body 202 and/or the mouthpiece 206 of previously described embodiments. Specifically, in the depicted embodiment, the rig 550 includes a main body 552 and a mouthpiece 554. The main body 552 may be similar to the main body 202 of vaporization rig 200 at least insofar as it may be able to receive water (or some other liquid substance) and may define one or pathways that allow vapor generated at the nail 520 (and received via passageway 514) to flow into the mouthpiece 206. The mouthpiece 554 may provide a port via which a user may inhale vapor (like mouthpiece 206). Additionally, the main body 552 (or the mouthpiece 554 if rig 550 does not include a main body 552) may be removably or irremovably coupled (e.g., seated in or formed with) to the main body 504 of the support structure 502.

Still referring to FIGS. 10-13, in this embodiment, the second receptacle 508 (i.e., nail receptacle 508) is proximate the back end 5043 of the main body 504 of the support structure 502 and the first receptacle 506 (i.e., rig receptacle 506) is disposed closer to the front end 5041 of the main body 504 of the support structure 502. More specifically, the first receptacle 506 (i.e., rig receptacle 506) is positioned a distance from the front end 5041 that allows the receptacle 522 and bottom 524 of the nail to extend over and align with the front end 5041 (e.g., a distance defined by a lateral extension of neck 526), where the main body 504 defines a heat outlet 510. Thus, like the other embodiments discussed herein, the vaporization device 500 aligns a nail with a flame or other heat generated by a heat generating element 600 included in the device 500. This alignment is advantageous for at least the reasons discussed above discussed above in connection with other embodiments that provide such alignment.

Moreover, in the depicted embodiment, the main body 552 and the mount 528 are each substantially cylindrical at their bottom ends and are configured to connect to and/or extend from circular receptacles (506 and 508, respectively) that are dimensioned to mate therewith. However, in other embodiments, the main body 552 and/or the mount 528, or at least portions thereof, may have any shape or size that allow for removably or irremovable coupling, locking, keying, etc. For example, the mount 528 may have a specific shape that keys the mount into the second receptacle 508 in an orientation that aligns receptacle 522 with heat outlet 510.

Regardless of the particular features of nail 520 and rig 550, when the nail 520 and the rig 550 are connected to the support structure 502 (e.g., once removably installed therein or once manufactured therewith), passageway 514 connects the nail 520 to the rig 550. That is, regardless of the exact locations of receptacles 506 and 508, a passageway 514 defined within an internal cavity 512 of the support structure 502 may fluidly couple first receptacle 506 to second receptacle 508. In the depicted embodiment, the passageway 514 is defined by portions of the main body 504 disposed within the internal cavity 512. However, in other embodiments, the passageway 514 may defined by glass, quartz, or another such material that is installed within and supported by the main body 504 (e.g., held in place by support ribs). Thus, the passageway 514 may be irremovable from the main body 504 of the support structure 502.

Alternatively, in some embodiments, the passageway 514 may be a chamber or cavity configured to receive a fluid, such that the passageway 514 can act as the main body of a vaporization rig. In such embodiments, rig 550 might only comprise mouthpiece 554 (and may be referred to as mouthpiece 550). That is, in some embodiments, the support structure may include features or in components that allow a mouthpiece 550, support structure 502, and nail 520 to collectively form and/or act as a vaporization rig.

Figure 13:
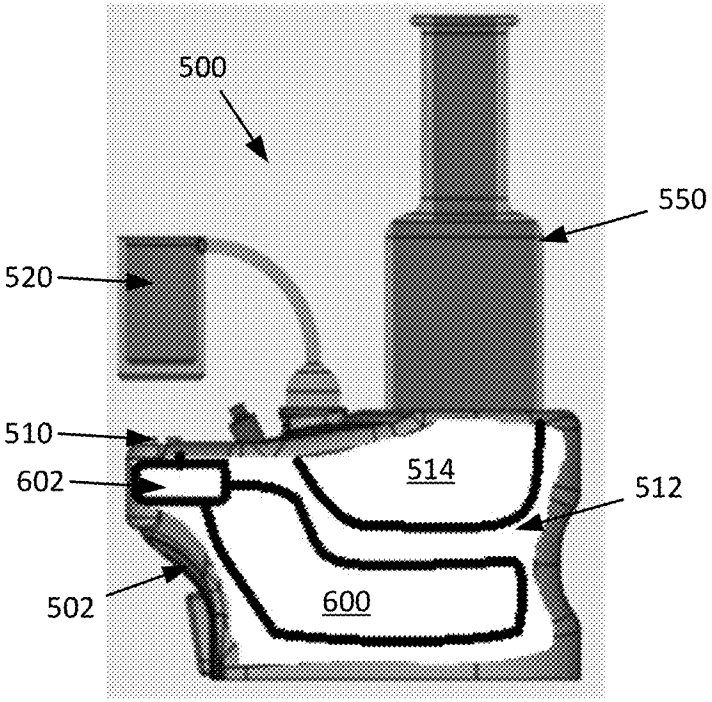
FIG. 13 illustrates a side sectional view of the vaporization device of FIG. 10.
Figure 12:
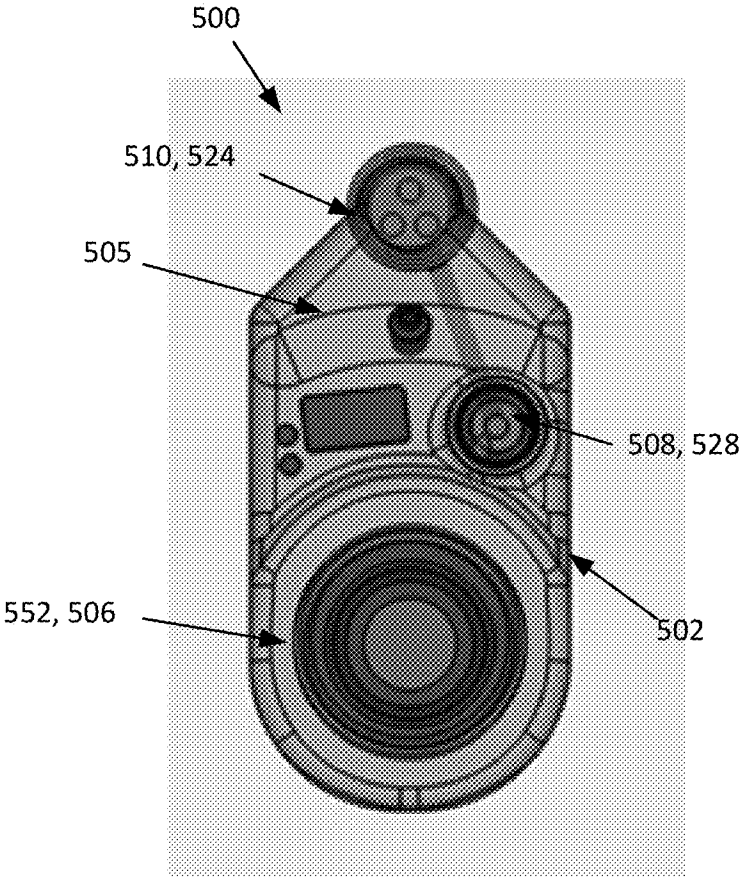
FIG. 12 illustrates a top view of the vaporization device of FIG. 10.

Still referring to FIGS. 10-13, but now with a focus on FIG. 13, to generate heat at the heat outlet 510, the vaporization device 500 includes a heating element 600. Specifically, in the depicted embodiment, the vaporization device 500 includes a heating element 600 formed or disposed within the internal cavity 512 defined by the main body 504 of the support structure 502. The cavity 512 may be a sealed cavity such that the torch cannot be removed from the main body 504. In fact, in some embodiments, the cavity 512 may be sealed except for a refueling/charging passage so that a user cannot access or alter the heating element 600 in any manner except to refuel and/or charge the heating element 600. That is, the heating element 600 may be irremovably installed or formed within cavity 512. Alternatively, the main body 504 may be formed from pieces that can removably coupled together and/or with an access panel (or other similar feature) to allow access to the heating element 600 (e.g., to allow battery changes).

In the depicted embodiment, the heating element 600 is primarily disposed beneath a passageway 514 defined by within the internal cavity 512, but in other embodiments, the heating element 600 and passageway 514 may have any shape and be arranged in any arrangement within cavity 512. Regardless, when a heating element 600 is disposed within the cavity 512, a heat generation portion 602 of the heating element 600, which may include any components now known or developed hereafter for generating heat (e.g., via a flame), such as a housing similar to housing 305 and/or a flame guide similar to flame guide 304, will be disposed beneath and in alignment with heat outlet 510, which aligns any heat generated by heating element 600 (e.g., a flame) with a heatable portion (e.g., bottom 524) of nail 520. Thus, when the heating element 600 is activated/actuated, the heating element 600 will act on nail 520 and heat any substances disposed therein.

In at least some embodiments, the heating element 600 may be actuated via an actuator built into or extending through support structure. For example, support structure 502 includes an actuator 5042 on its front end 5041 for actuating the heating element 600. An actuator 5042 disposed on the front end 5041 of the main body 504 of the support structure may naturally align with a user's hand (e.g., with their index finger) when a user is holding the vaporization device 500 in a position to bring the mouthpiece 554 to their mouth. Thus, a user can easily operate the vaporization device 500 with one hand, like vaporization device 10 (as is discussed above in connection with at least FIG. 5). In fact, to facilitate easy one-handed gripping, the main body 504 may have contoured sides that create a grip along the side of the main body (between ends 5041 and 5043) and guide a user's finger to the actuator 5042. Thus, vaporization device 500 may achieve the portability, safety, and ease-of-use advantages discussed herein.

While the invention has been illustrated and described in detail and with reference to specific embodiments thereof, it is nevertheless not intended to be limited to the details shown, since it will be apparent that various modifications and structural changes may be made therein without departing from the scope the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the vaporization device of the present invention, or portions thereof, may be fabricated from any suitable material or combination of materials, provided that the device, or portions thereof, can function as described herein (i.e., withstand heating forces and form sealed connections). Example materials include plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed is:

1. A vaporization apparatus configured to support a vaporization rig and a heating element, the vaporization apparatus comprising a body including:

a front end and a back end being bounded by a top and a bottom;

a first receptacle, originating at an opening in the front end or the back end, having one or more sidewalls that define a cavity which laterally extends within the body from the opening and that removably supports the heating element so that the heating element can be installed in the first receptacle and used as a part of the vaporization apparatus or be removed from the vaporization apparatus and used separately from the vaporization apparatus; and a second receptacle defined in the top, which longitudinally extends within the body from a top surface, the entirety of which is located above the laterally-extending cavity of the first receptacle, the second receptacle sized to support the vaporization rig, wherein the second receptacle includes a bottom and one or more sidewalls that surround a perimeter of the bottom, the one or more sidewalls being configured to frictionally engage sidewalls of a main body of the vaporization rig to removably secure the vaporization rig in the second receptacle, and wherein the first receptacle and the second receptacle are positioned to align a heatable portion of the vaporization rig with a heat generating portion of the heating element.

2. The vaporization apparatus of claim 1, wherein the first receptacle extends through the entire body or the first receptacle terminates within the body.

3. The vaporization apparatus of claim 1, wherein the second receptacle is a cuboidal receptacle and the main body of the vaporization rig is shaped to mate with the cuboidal receptacle.

4. The vaporization apparatus of claim 1, further comprising:

a grip member disposed between the second receptacle and the vaporization rig, the grip member configured to increase an amount of friction between the second receptacle and the vaporization rig.

5. The vaporization apparatus of claim 4, wherein the grip member is a planar grip member.

6. The vaporization apparatus of claim 5, wherein the planar grip member is fixedly coupled to the bottom of the second receptacle.

7. The vaporization apparatus of claim 4, wherein the grip member comprises a sleeve that wraps around a bottom and at least a portion of the sidewalls of the main body of the vaporization rig and also engages the bottom and the one or more sidewalls of the second receptacle.

8. The vaporization apparatus of claim 7, wherein the sleeve is removably coupleable to at least one of the second receptacle and the main body of the vaporization rig.

9. The vaporization apparatus of claim 1, wherein the first receptacle aligns a bottom of the heatable portion of the vaporization rig with heat generated by the heat generating portion of the heating element.

10. The vaporization apparatus of claim 1, wherein the body of the vaporization apparatus is sized to be held by a user in one hand.

11. A vaporization apparatus configured to support a vaporization rig and a heating element that is usable separately from the vaporization apparatus, the vaporization apparatus comprising a body including:

a planar bottom surface configured to sit stably on a support surface;

a top surface disposed opposite the planar bottom surface;

a front end and a back end being bounded by the top surface and the planar bottom surface;

a first receptacle that originates at an opening in the front end or the back end and laterally extends within the body from the opening, wherein the first receptacle removably supports the heating element so that the heating element can be installed in the first receptacle and used as a part of the vaporization apparatus or be removed from the vaporization apparatus and used separately from the vaporization apparatus;

a second receptacle defined in the top surface, which longitudinally extends within the body from the top surface, the entirety of which is located above the laterally-extending cavity of the first receptacle, the second receptacle being sized to support the vaporization rig, wherein the second receptacle includes a bottom and one or more sidewalls that surround a perimeter of the bottom, the one or more sidewalls being configured to frictionally engage sidewalls of a main body of the vaporization rig to removably secure the vaporization rig in the second receptacle, and wherein the first receptacle and the second receptacle are positioned to align a heatable portion of the vaporization rig with a heat generating portion of the heating element; and a side of the body that defines a contoured grip extending along at least a portion of the side of the body so that a user can grip the body without contacting the first receptacle or the second receptacle.

12. The vaporization apparatus of claim 11, wherein the first receptacle extends through the entire body or the first receptacle terminates within the body.

13. The vaporization apparatus of claim 11, wherein the second receptacle is a cuboidal receptacle and the main body of the vaporization rig is shaped to mate with the cuboidal receptacle.

14. The vaporization apparatus of claim 11, further comprising:

a grip member disposed between the second receptacle and the vaporization rig, the grip member configured to increase an amount of friction between the second receptacle and the vaporization rig.

15. The vaporization apparatus of claim 14, wherein the grip member is a planar grip member.

16. The vaporization apparatus of claim 15, wherein the planar grip member is fixedly coupled to the bottom of the second receptacle.

17. The vaporization apparatus of claim 14, wherein the grip member comprises a sleeve that wraps around a bottom and at least a portion of the sidewalls of the main body of the vaporization rig and also engages the bottom and the one or more sidewalls of the second receptacle.

18. The vaporization apparatus of claim 17, wherein the sleeve is removably coupleable to at least one of the second receptacle and the main body of the vaporization rig.

19. The vaporization apparatus of claim 11, wherein the first receptacle longitudinally aligns a bottom of the heatable portion of the vaporization rig with heat generated by the heat generating portion of the heating element.

20. The vaporization apparatus of claim 11, wherein the body of the vaporization apparatus is sized to be held by a user in one hand.

* * * * *